US007917979B2

(12) United States Patent
Amsler, Jr.

(10) Patent No.: US 7,917,979 B2
(45) Date of Patent: Apr. 5, 2011

(54) MATTRESS JACK

(76) Inventor: Fred R. Amsler, Jr., Eagles Mere, PA (US)

( * ) Notice: Subject to any disclaimer, the term of this patent is extended or adjusted under 35 U.S.C. 154(b) by 0 days.

(21) Appl. No.: 12/622,601

(22) Filed: Nov. 20, 2009

(65) Prior Publication Data

US 2010/0064434 A1 Mar. 18, 2010

Related U.S. Application Data

(63) Continuation-in-part of application No. 12/454,891, filed on May 26, 2009, now abandoned, which is a continuation-in-part of application No. 12/284,541, filed on Sep. 23, 2008, now abandoned, which is a continuation of application No. 12/070,139, filed on Feb. 15, 2008, now abandoned.

(60) Provisional application No. 60/976,055, filed on Sep. 28, 2007.

(51) Int. Cl.
*A47C 21/06* (2006.01)

(52) U.S. Cl. ..... 5/488; 5/659; 5/692

(58) Field of Classification Search ..... 5/488, 659, 5/692; 254/93 HP
See application file for complete search history.

(56) References Cited

U.S. PATENT DOCUMENTS 4,807,313 A * 2/1989 Ryder et al. ..... 5/610
5,257,430 A 11/1993 Yamaguchi
5,313,679 A * 5/1994 Yamaguchi ..... 5/659
6,795,989 B2 9/2004 Fairchild et al.

* cited by examiner

*Primary Examiner* — Michael Trettel
(74) *Attorney, Agent, or Firm* — James Ray & Assoc

(57) ABSTRACT

An apparatus for lifting a mattress to an optimal work level so as to facilitate the bed making process. A generally rectangular size specific inflatable member is disposed between a mattress and box springs in an unsecured manner so as to create a functional space between the mattress and inflatable member into which the bed linen can be secured during the bed making process. A fluid communication means is engageable with the inflatable member and an air pump is engageable with the fluid communication means for providing air for inflating the inflatable member. A power means provides power to operate the air pump and a switch activates and deactivates the air pump. A valve controls inflation and deflation of the inflatable member.

19 Claims, 3 Drawing Sheets

MATTRESS JACK

CROSS REFERENCE TO RELATED APPLICATIONS

This application is a Continuation-in-Part application of and claims benefit from Continuation-in-Part U.S. patent application Ser. No. 12/454,891 filed May 26, 2009 and now abandoned, and further claims benefit of Continuation-in-Part U.S. patent application Ser. No. 12/284,541, filed Sep. 23, 2008 and now abandoned, which is a Continuation of U.S. patent application Ser. No. 12/070,139, filed Feb. 15, 2008 and now abandoned, which in turn claims benefit from U.S. Provisional Application No. 60/976,055 filed Sep. 28, 2007.

FIELD OF THE INVENTION

The present invention relates, in general, to an aid in the bed making process and, more particularly, the present invention relates to a mattress jack that raises the mattress from the box springs so as to eliminate the need for a person or persons to physically lift and manipulate a heavy mattress during the bed making process and enable the user to complete the bed making process while the mattress is still elevated on the air bladder.

BACKGROUND OF THE INVENTION

Homemakers must regularly clean and change the sheets and linens on the beds in their homes, a task that necessarily involves repetitive lifting and manipulating a heavy, bulky mattress during the bed making process. Most homemakers, both young and old, find that lifting a heavy mattress with one hand and positioning the sheets and blankets with the other hand is next to impossible unless they have help. Even with two persons working together, making a bed is a strenuous task.

Likewise, hotel housekeepers at hotels, motels and inns must routinely change the linen on many beds every day. The stress and strain associated with the repetitive lifting of heavy mattresses during the bed making process eventually takes a toll on the worker in the form of lifting injuries, work loss, and even workman's compensation insurance claims in the case of commercial establishments.

In prior art, Fairchild et al. in U.S. Pat. No. 6,795,989 B2 teaches the use of an inflatable air bladder to raise a mattress from the box springs. Further, Fairchild teaches that the mattress and air bladder are connected together with "fasteners" at specific locations "adjacent to each of the corners of the bladder". However, using fasteners of any kind to lock the mattress to the air bladder interferes with the bed making task.

The "fasteners" are designed to secure the air bladder to cooperating fasteners on the overlying mattress. The problem is that when air bladder fasteners are secured to the cooperative fasteners on the mattress, it is not possible to place ("tuck in") the bed linen and blankets between the air bladder and the overlying mattress. In other words the "prescribed" fasteners make it virtually impossible to slide (position) linen between the mattress and the air bladder.

Further, Fairchild et al. teaches the need for an opening that "comprises a needle valve extending through the surface of said bladder." Fairchild et al. also teach an air bladder being of an X-shape, I-shape or H-shape configuration. The specific shape designation is stipulated so that the . . . "volume of air required to inflate said bladder is minimized."

The prior art of Yamaguchi in U.S. Pat. No. 5,257,430 also provides an inflatable air bladder for raising a mattress.

Yamaguchi teaches various sizes and shapes of air mattresses. The one constant that is present in all of Yamaguchi's designs is that there is a plurality of inflatable members connected to non-inflatable members. This is quite different from the present invention.

In order to maximize the benefits of raising a mattress to an optimal work level, to eliminate all the heavy lifting and minimize bending and kneeling, the ideal bed making apparatus must provide a means to secure ("tuck in") the top sheet and blankets under the mattress while the mattress is positioned at the optimal work level by the inflated air bladder.

Both Fairchild and Yamaguchi focus on raising the mattress to eliminate strenuous lifting; however, both designs fail to provide an efficient means to secure the clean linen and blankets between the mattress and inflated air bladder. As a result both patents require the operator to lower the mattress onto the box springs before the linen and blankets can be properly secured. At this point the operator must resort to strenuous lifting and bending to complete the bed making task. The obvious problem is that lowering the mattress in order to secure the linen and blankets defeats the purpose and negates the important benefits of raising the mattress on an air bladder in the first place. With the present invention, the sheets and blankets can be easily positioned and secured under the mattress while the mattress is held at the optimal level by the inflated air bladder.

Thus, it would be advantageous if there were an apparatus, like the present invention, which (1) elevates the mattress throughout the bed making task, and (2) provides a means to conveniently secure the bed linen and blankets under the mattress while the mattress is still supported at an optimal work level by the inflated air bladder. Such an apparatus ensures that the bed making task can be completed while the mattress is raised to an optimal work level. In most cases, a well designed apparatus also enables a single person to do the job by himself/herself without the need for an assistant.

SUMMARY OF THE INVENTION

In a first aspect the present invention provides an apparatus for lifting a mattress so as to make changing bed linens less strenuous. The apparatus comprises a generally rectangular inflatable member disposed between a mattress and a supporting structure of a bed in an unsecured manner so as to make changing of such bed linens easy, said inflatable member having a predetermined size and being formed of a predetermined material. A fluid communication means is engageable at a first end thereof with the inflatable member and an air pump is engageable with a second end of the fluid communication means for providing up to about 3 PSI of air for inflating the inflatable member to a substantially uniform pressure throughout an entire perimeter of such inflatable member. A power means is engageable with the air pump for providing power to operate the air pump and a switch means is engageable between the power means and the air pump means for activating and deactivating the air pump. A valve means is disposed in one of the fluid communication means and the pump means for controlling both inflation and deflation of the inflatable member.

In a second aspect of the present invention there is provided in combination with a box spring the improvement comprising an apparatus for lifting a mattress so as to eliminate a need for physically lifting and manipulating a heavy mattress during the bed making process. The apparatus includes a generally rectangular inflatable member engageable with said box spring and disposed between said box spring and such mattress in an unsecured manner so as to make changing of such bed linens easy, such inflatable member for providing lifting support of such mattress and wherein said inflatable member is sized to support such mattress, the inflatable member being disposed about two inches from the side and foot-end edges of the mattress. A pump means is engageable with the inflatable member for providing up to about 3 PSI of air for inflating said inflatable member to a substantially uniform pressure throughout an entire perimeter of such inflatable member and a control means is engageable with the pump means for controlling both inflation and deflation of such inflatable member.

In a third aspect the present invention provides in combination with a mattress and box springs an inflatable member disposed between such mattress and such box springs. The inflatable member being sized so as to be disposed a predetermined distance from an edge of the mattress so as to create and provide a functional space between the mattress and the inflatable member into which bed linens can be secured during a bed making task. As the inflatable member is deflated, the bed linen continues to be secured in the functional space while the mattress is lowered onto the box springs at which time such bed linens and blankets are secured between the mattress and the box springs.

OBJECTS OF THE INVENTION

It is, therefore, one of the primary objects of the present invention to provide an apparatus that can lift the mattress when needed.

Another object of the present invention is to provide an apparatus that is air powered.

Still another object of the present invention is to provide an apparatus that is inflatable.

Yet another object of the present invention is to provide an apparatus that can be sized to fit different size mattresses.

Another object of the present invention is to provide an apparatus that is inflated by either an electric air pump or a manual air pump.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

DETAILED DESCRIPTION OF THE INVENTION

Figure 1:
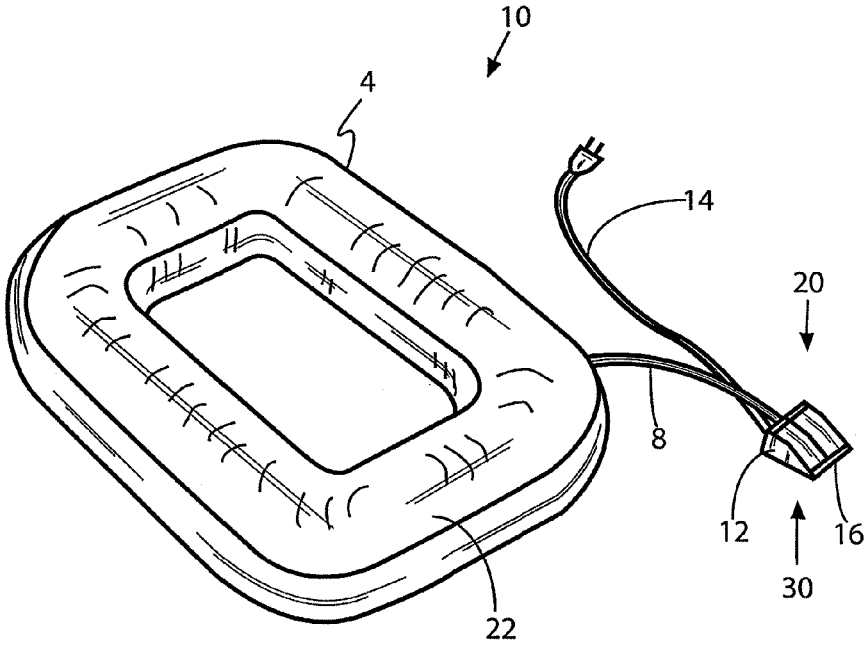
FIG. 1 is a top perspective view of the inflatable apparatus for raising a mattress according to an embodiment of the invention.
Figure 4:
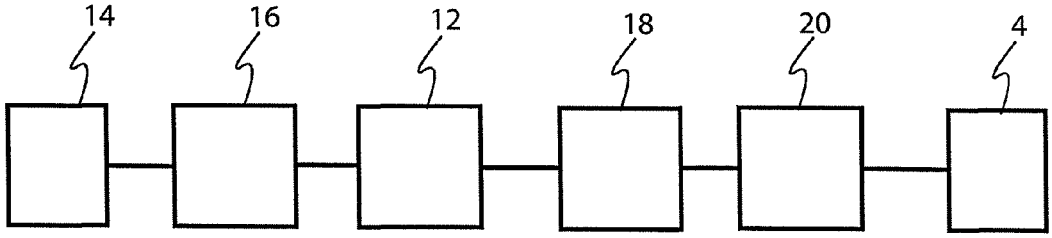
FIG. 4 is block diagram of the operation of the apparatus as shown in the previous Figures.
Figure 2:
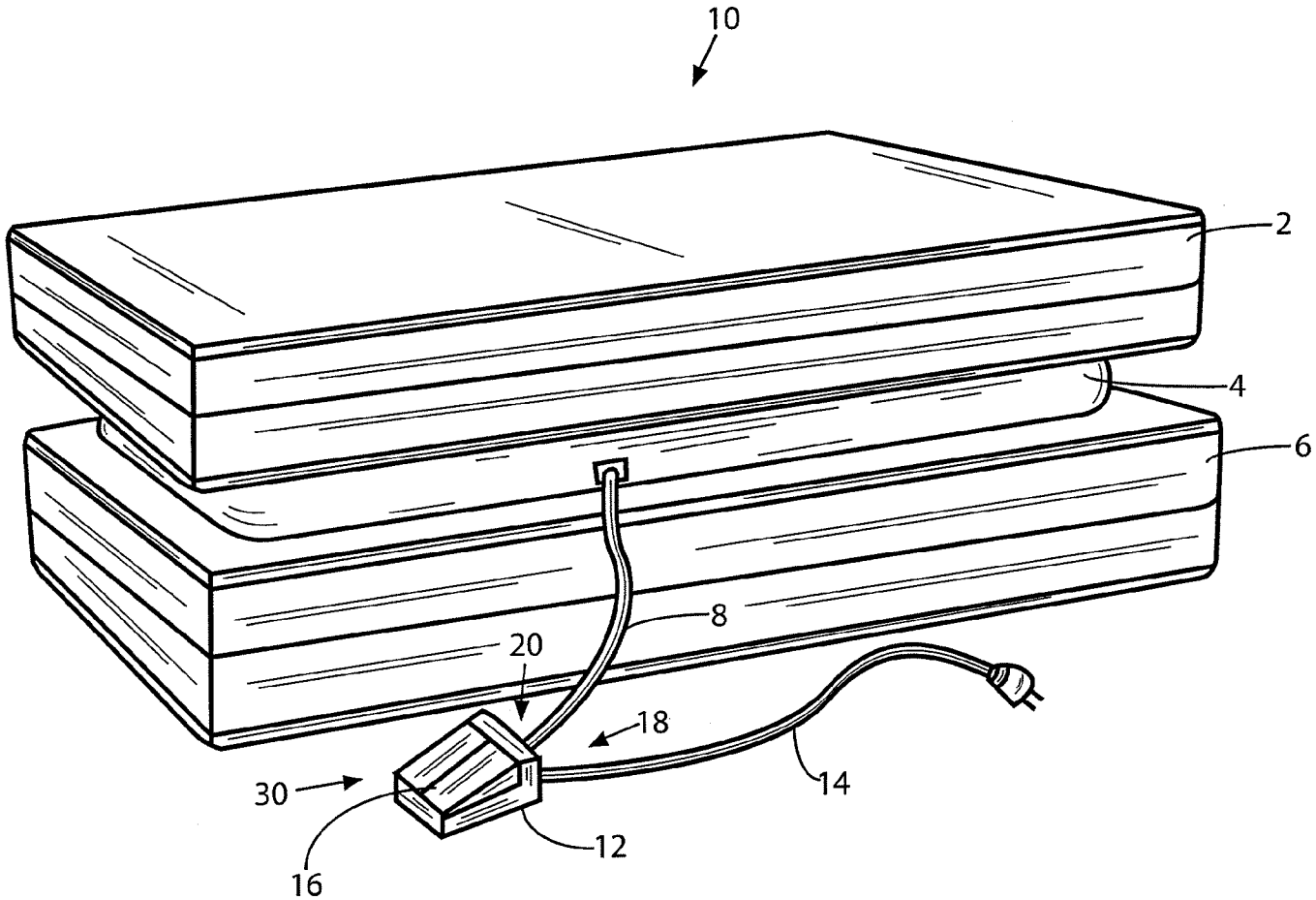
FIG. 2 is a side perspective view of a mattress and box springs with the inflatable member shown in FIG. 1 disposed therebetween.

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for lifting a mattress 2 so as to make changing bed linens less strenuous. The apparatus 10 comprises a generally rectangular inflatable member 4 that is disposed between a mattress 2 and a supporting structure 6 of a bed in an unsecured manner so as to make changing of such bed linens easy, such inflatable member 4 having a predetermined size and being formed of a predetermined material. A fluid communication means 8 is engageable at a first end thereof with the inflatable member 4 and an air pump 12 is engageable with a second end of the fluid communication means 8 for providing up to about 3 PSI of air for inflating the inflatable member 4 to a substantially uniform pressure throughout an entire perimeter of such inflatable member. In a presently preferred embodiment a power means 14 is engageable with the air pump 12 for providing power to operate the air pump 12 and a switch means 16 is engageable between the power means 14 and the air pump 12 for activating and deactivating the air pump 12. A valve means 18 is disposed in one of the fluid communication means 8 and the air pump 12 for controlling inflation and deflation of the inflatable member 4.

In an embodiment of the invention a vent means, generally designated 20, is disposed in one of the air pump 12 and the fluid communication means 8 for venting the inflatable member 4 as necessary.

It should be mentioned that such supporting structure 6 is generally a box spring 6; however, there may be some instances where something other than a box spring 6 is used as a supporting structure 6 for the mattress 2.

It is presently preferred that the air pump 12 is electrically controlled and the power means 14 operates at a voltage and amperage appropriate for the air pump 12. Generally this will be a standard 110 volt house circuit. Such switch means 16 is one of a foot pedal and a hand operated switch.

It is presently preferred that such generally rectangular shape of the inflatable member 4 is a generally rectangular shaped donut or a rectangular "life-boat" shaped tubular device with more or less flat upper and lower surfaces.

The predetermined material used to form the inflatable member 4 is one of natural rubber, synthetic rubber, plastic or similar pliable material to be selected based on the desired physical characteristics and availability. The selected material must be a durable material that is ideal for inflatable products.

It is presently preferred that such material be plastic and even more preferred that such plastic is polyvinyl chloride. Such apparatus 10 further may include a semi smooth surface which serves to stabilize the inflatable member 4 in place between the mattress 2 and the box springs.

It should be mentioned that the present invention is disposed between the box springs and the mattress in an unsecured manner, that means that no fasteners, such as hook and loop, snaps or other means are required on the mattress and/or the inflatable member. Thus, when using the present invention the homemaker simply tucks in the sheets and blanket between the inflated inflatable member 4 and the mattress. The bed linen and blankets are held in place by the weight of the mattress on the inflated inflatable member until the bed linen and blankets are secured between the mattress and box springs when the inflatable member has been fully deflated. As stated previously the present invention does not specify or require any kind of fasteners such as are needed and taught in the Fairfield patent.

Mattress manufacturers, contrary to previous teaching which recommended that mattresses be turned over, now recommend that mattresses should be rotated 180 degrees on a regular basis. This is particularly true for the new generation of queen and king sized mattresses. The rotation of the mattress can be done with a minimum of effort when such rotation is done on an inflated inflatable member of the present invention.

It should be pointed out that the size of the inflatable member is critical, as the inflated air bladder should be about two inches from the edge of the mattress. This arrangement allows the sheets and blankets to be easily tucked in place between the mattress and the inflated air bladder. This is why the present invention is size specific; one size for standard double beds, one for queen sized beds and another for king sized beds. The cross sectional shape of the air bladder is substantially square with rounded corners. This square shape provides maximal contact between the mattress and the air bladder which effectively holds sheets and blankets in the desired position between the mattress and air bladder. The present invention is designed with a larger substantially rectangular air bladder so that it can lift a larger and heavier mattress with lower air pressure than required in the Fairfield patent. The air pressure needed to inflate the inflatable member 4 of the present invention is 3 PSI or lower. The benefits of having a lower air pressure is that the fully inflated air bladder is soft and malleable so that sheets and blankets can be easily tucked in and secured between the mattress and air bladder. Also by inflating the air bladder with a low tech electric air pump serves to make the present invention more cost effective.

The air bladder of the present invention is constructed using semi-smooth material that allows the mattress to be easily moved about on the inflated air bladder. The material also allows the inflated air bladder to be easily moved about on the box springs. There are no connectors of any kind between the mattress, the air bladder and the box springs. This feature is important for two reasons:

(a) Older mattresses were designed to be flipped or turned over every six to twelve months to promote even wear. However, the new generation of thick and heavy mattresses, particularly the King and Queen type mattresses are designed to be rotated horizontally 180 degrees every three to six months. These new mattresses are not designed to be turned over or flipped. The inflated air bladder of the present invention enables the user to easily rotate these large and heavy mattresses.

(b) When making a bed, users often find it is helpful to slide the mattress a little bit one way or the other in order to position the tightly fitted contour bottom sheet on the mattress. The inflated air bladder of the present invention allows the operator to easily slide the mattress about on the inflated air bladder.

Further, it should be noted that inflation and deflation of the inflatable member is accomplished through a single fitting by a remote controlled electric air pump.

Figure 3:
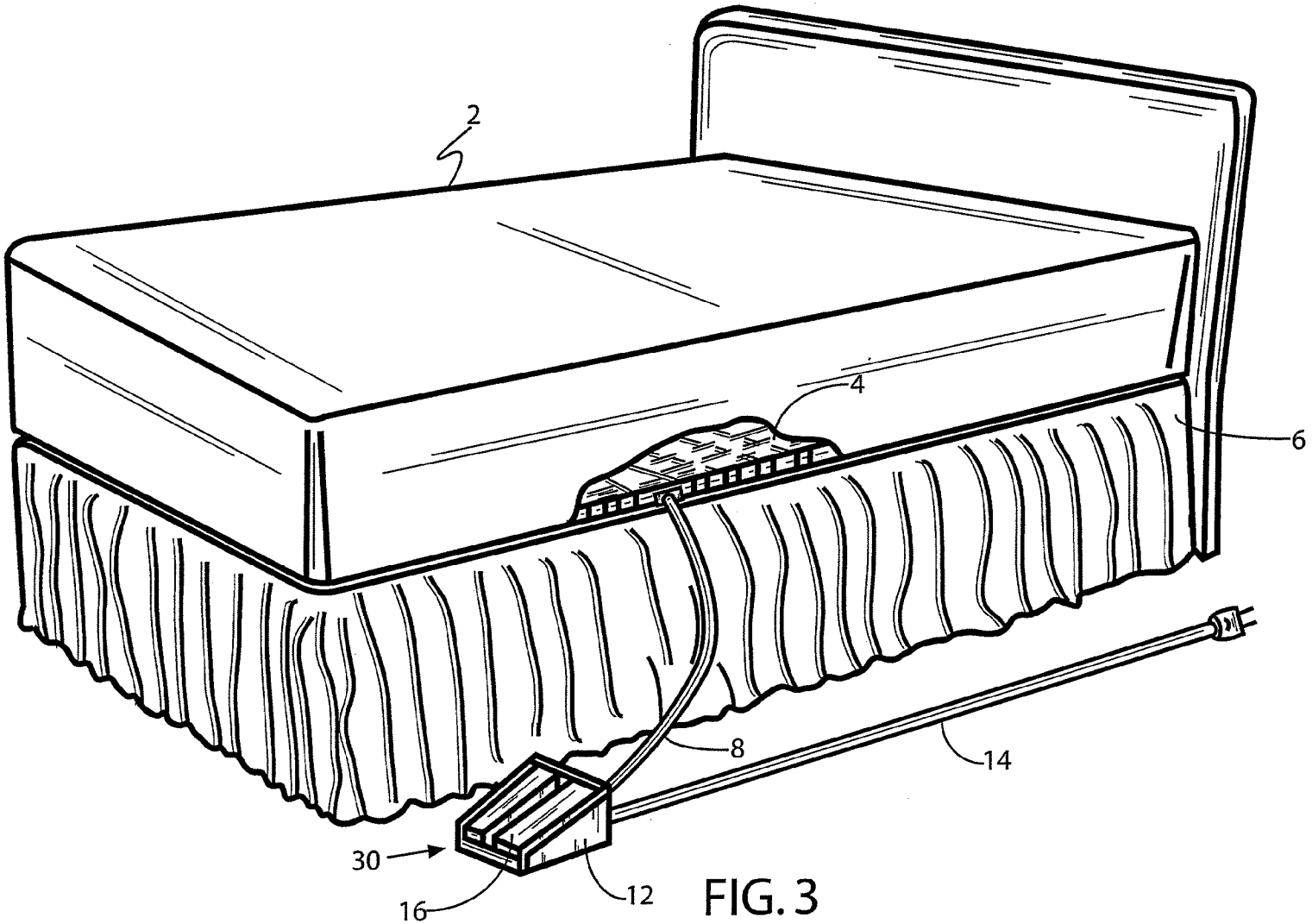
FIG. 3 is a side perspective view of the mattress and box springs with an uninflated apparatus disposed therebetween.

The switch means 16 has an inflating position and a deflating position. When the switch 16 is in the inflating position the air pump 12 pumps air to fill the inflatable member 4 to the desired level. When the switch is turned off the valve means 18 prevents air from leaving the inflatable member 4. After use the switch means 16 is turned to the deflating position and air in the inflatable member 4 is removed by the air pump 12 or by means of an exhaust valve. Once deflated the inflatable member 4 becomes flat and is not noticeable between the mattress 2 and box springs 6 as is seen in FIG. 3.

In a second aspect of the present invention there is provided in combination with a box spring 6 the improvement comprising an apparatus 10 for lifting a mattress 2 so as to eliminate a need for physically lifting and manipulating a heavy mattress 2 during the bed making process. Such apparatus 10 includes a generally rectangular inflatable member 4 engageable with said box spring 6 and disposed between said box spring 6 and such mattress 2. Such inflatable member 4 is disposed in an unsecured manner with the mattress so as to make changing of such bed linens easy, such inflatable member provides lifting support of such mattress 2 and wherein the inflatable member 4 is sized to support edge portions of such mattress 2. There is a pump means 12 engageable with the inflatable member 4 for providing up to about 3 PSI of air for inflating such inflatable member 4 to a substantially uniform pressure throughout an entire perimeter of such inflatable member, and a control means 30 engageable with the pump means 12 for controlling both inflation and deflation of the inflatable member 4.

In a third aspect the present invention provides in combination with a mattress and box springs an inflatable member disposed between such mattress and such box springs. The inflatable member being sized so as to be disposed a predetermined distance from the sides and foot-edges of the mattress so as to provide a functional space between the mattress and the inflatable member into which bed linens can be secured during a bed making task until the inflatable member is deflated and the mattress is lowered onto such box springs at which time such bed linens and blankets are secured between the mattress and the box springs.

Thus, the present invention provides an apparatus (mattress jack) that is a unique inflatable device that is positioned between the mattress and box springs of a bed. Although the apparatus can be made in a variety of shapes, it is presently preferred that the apparatus is rectangular in shape since most mattresses and box springs are also rectangular. The shape of the inflatable member is that of a rectangular donut or similar to an inflatable life raft minus the bottom portion. An uninflated air bladder is installed between the mattress and box springs. When activated an electric air pump inflates the apparatus which automatically raises the mattress from the box springs. The air pump has an electric cord which can be plugged into any 110 volt house circuit. A switch means controls the air pump and controls inflation or deflation of the apparatus. The switch means can be either a foot pedal or a hand operated switch that is placed in a convenient location near the bed. The apparatus is constructed of a durable plastic, natural rubber, synthetic rubber or similar pliable material and may have a semi smooth surface which serves to keep the apparatus in place between the mattress and box springs at all times whether in the inflated or deflated mode.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for lifting a mattress so as to eliminate a need for physically lifting and manipulating a heavy mattress during the bed making process, thereby making changing bed linens less strenuous, said apparatus comprising:

(a) a generally rectangular ring shaped inflatable member with a generally constant cross section disposed between a mattress and a supporting structure of a bed in an unsecured manner so as to make changing of such bed linens easy, said inflatable member having a predetermined size and being formed of a predetermined material;

(b) a fluid communication means engageable at a first end thereof with said inflatable member;

(c) an air pump engageable with a second end of said fluid communication means for providing up to about 3 PSI of air for inflating said inflatable member to a substantially uniform pressure throughout an entire perimeter of said inflatable member;

(d) a power means engageable with said air pump for providing power to operate said air pump;

(e) a switch means engageable between said power means and said air pump means for activating and deactivating said air pump; and (f) a valve, means disposed in one of said fluid communication means and said air pump for controlling both inflation and deflation of said inflatable member.

2. The apparatus, according to claim 1, wherein said air pump is electrically controlled.

3. The apparatus, according to claim 1, wherein said switch means is one of a foot pedal and a hand operated switch.

4. The apparatus, according to claim 2, wherein said power means operates at a voltage and amperage appropriate for said air pump.

5. The apparatus, according to claim 4, wherein said power means is a standard 110 volt house circuit.

6. The apparatus, according to claim 1, wherein said predetermined material is one of natural rubber, synthetic rubber and plastic.

7. The apparatus, according to claim 6, wherein said predetermined material is plastic.

8. The apparatus, according to claim 1, wherein said inflatable member further includes a semi-smooth surface which serves to help keep said inflatable member in place between such mattress and such box springs.

9. The apparatus, according to claim 1, wherein said switch means includes a deflating position.

10. The apparatus, according to claim 9 wherein said apparatus further includes a vent means disposed one of in said pump means and said fluid communication means for venting said inflatable member as necessary.

11. The apparatus, according to claim 10, wherein said air pump deflates said inflatable member through said vent means when said switch is turned to said deflating position.

12. The apparatus, according to claim 1, wherein said supporting structure is a box spring.

13. The apparatus, according to claim 1, wherein said inflatable member is disposed about two inches from sides and a foot-end of a mattress.

14. In combination with a box spring the improvement comprising an apparatus for lifting a mattress so as to eliminate a need for physically lifting and manipulating a heavy mattress and minimize a need for strenuous bending and kneeling during a bed making process, said apparatus including:

(a) a generally rectangular ring shaped inflatable member with a generally constant cross section engageable with said box spring and disposed between said box spring and such mattress, said inflatable member is disposed in an unsecured manner with such mattress so as to make such changing of such bed linen easy, said inflatable member for providing lifting support of such mattress and wherein said inflatable member is sized to support edge portions of such mattress;

(b) a pump means engageable with said inflatable member for providing up to about 3 PSI of air for inflating said inflatable member to a substantially uniform pressure throughout an entire perimeter of said inflatable member; and (c) a control means engageable with said pump means for controlling both inflation and deflation of said inflatable member.

15. The combination, according to claim 14, wherein said combination further includes a fluid communication means engageable with said inflatable member, said pump means and said control means.

16. The combination, according to claim 14, wherein said pump means is an air pump.

17. The combination, according to claim 15, wherein said combination further includes a vent means disposed in one of said air pump and said fluid communication means for venting said inflatable member as necessary.

18. In combination with a mattress and box springs the present invention provides a ring shaped inflatable member with a generally constant cross section disposed between said mattress and said box springs, said inflatable member being sized so as to be disposed a predetermined distance from a side and foot-edges of said mattress so as to create and provide a functional space between said mattress and said inflatable member into which bed linens can be secured during a bed making task until said inflatable member is deflated and said mattress is lowered onto said box springs at which time such bed linens and blankets are secured between said mattress and said box springs.

19. The combination, according to claim 18, wherein said predetermined distance is two inches.

* * * * *